US005220891A

United States Patent [19]

Nakamura et al.

[11] Patent Number: 5,220,891

[45] Date of Patent: Jun. 22, 1993

[54] VARIABLE CAM ENGINE

[75] Inventors: Makoto Nakamura; Shigeru Sakurai; Mituo Gungi; Tsuyoshi Masuda, all of Yokohama, Japan

[73] Assignee: Nissan Motor Co., Ltd., Yokohama, Japan

[21] Appl. No.: 852,061

[22] Filed: Mar. 16, 1992

[30] Foreign Application Priority Data

Mar. 15, 1991 [JP] Japan ..... 3-075887

[51] Int. Cl.[5] ..... F01L 1/34; F01M 1/06; F01M 9/10

[52] U.S. Cl. ..... 123/90.15; 123/90.33; 123/196 R

[58] Field of Search ..... 123/90.15, 90.16, 90.33, 123/90.34, 196 R, 196 M

[56] References Cited

U.S. PATENT DOCUMENTS

| | | | |
|---|---|---|---|
| 4,768,467 | 9/1988 | Yamada et al. | 123/90.16 |
| 4,794,892 | 1/1989 | Konno | 123/90.16 |
| 4,799,463 | 1/1989 | Konno | 123/90.16 |
| 4,800,850 | 1/1989 | Yoshida et al. | 123/90.16 |
| 4,854,273 | 8/1989 | Uesugi et al. | 123/90.16 |
| 4,907,550 | 3/1990 | Inoue et al. | 123/90.16 |
| 4,928,641 | 5/1990 | Niizato et al. | 123/90.16 |
| 4,962,732 | 10/1990 | Inoue et al. | 123/90.16 |

FOREIGN PATENT DOCUMENTS

| | | |
|---|---|---|
| 62-294709 | 12/1987 | Japan . |
| 63-57805 | 3/1988 | Japan . |
| 63-167016 | 7/1988 | Japan . |

OTHER PUBLICATIONS

Inoue, K. et al., SAE Technical Paper Series 890675, "A High Power, Wide Torque Range, Efficient Engine with a Newly Developed Variable-Valve-Lift and-Timing Mechanism", Honda R&D Co., Ltd. (International Congress and Exposition, Detroit, Mich., Feb. 27-Mar. 3, 1989.

*Primary Examiner*—E. Rollins Cross
*Assistant Examiner*—Weilun Lo
*Attorney, Agent, or Firm*—Foley & Lardner

[57] ABSTRACT

A variable cam engine is provided with a plurality of cams which open and close an intake valve and an exhaust valve, a cam change-over mechanism which changes over these cams according to the rise of the supplied oil pressure, a lubrication path which supplies lubricating oil discharged by an oil pump to the engine parts, and an oil pressure path which supplies part of this oil to the cam change-over mechanism. A throttle is provided in the lubrication path. By throttling this throttle in the low engine speed region, the oil pressure in the oil pressure path is maintained and the cams can be changed over by the change-over mechanism even when the engine is running at a low speed of, for example, 2500 rpm.

5 Claims, 4 Drawing Sheets

VARIABLE CAM ENGINE

FIELD OF THE INVENTION

This invention relates to a variable cam engine wherein cams for driving engine intake and exhaust valves are selected according to engine running conditions, and in particular relates to an oil pressure supply mechanism for selecting the cams.

BACKGROUND OF THE INVENTION

It is known that the optimum valve lift and lift timing for intake and exhaust in an engine differ according to engine running conditions.

To provide an optimum valve lift, Tokkai Sho 62-294709, published by the Japanese Patent Office, discloses a variable cam engine wherein several cams are selectively applied to one valve.

In this engine, a cam which gives high power on low engine speeds and a cam which gives high power on high engine speeds are selected alternately. The change-over between these cams is performed by oil hydraulic pressure, and for this purpose, part of the lubricating oil discharged from an oil pump attached to the engine is led into the cam change-over mechanism via a valve.

In order to perform cam change-over using lubricating oil in this way, a fairly large amount of oil has to be discharged from the pump. However, most oil pumps do not supply the requisite amount of oil until the engine speed has increased to approx. 3000 rpm, and when the engine speed is lower than this value, cam change-over either cannot take place or takes too long.

SUMMARY OF THE INVENTION

It is therefore an object of this invention to make it possible to perform cam change-over at low engine speeds in a variable cam engine.

In order to achieve the above object, this invention provides a variable cam engine having an intake valve, an exhaust valve, a plurality of cams of different shape which open and close one of these valves, a cam change-over mechanism driven by pressurized oil which changes over said cams when the pressure of the oil rises above a predetermined level, an oil pump which rotates according to the engine speed, a lubrication path which supplies lubricating oil discharged by said oil pump to the engine parts, and an oil pressure path which supplies part of the lubricating oil to said cam change-over mechanism. This engine further comprises a throttle provided in the lubrication path, a device for detecting engine speed, and a control device for throttling this throttle when the engine speed is in a predetermined low speed region.

It is preferable that the predetermined low speed region is from approx. 1000 to 3000 rpm and cam change-over mechanism performs cam change-over when the engine speed is in a region from approx. 2000 to 3000 rpm.

It is also preferable that the control device maintains the throttle fully open when the engine speed is below approx. 1000 rpm, reduces the throttle opening according to the engine speed from approx. 1000 to 2000 rpm, and maintains the minimum throttle opening from approx. 2000 to 3000 rpm.

The details as well as other features and advantages of this invention are set forth in the remainder of the specification and are shown in the accompanying drawings.

DESCRIPTION OF THE EMBODIMENT

Figure 1:
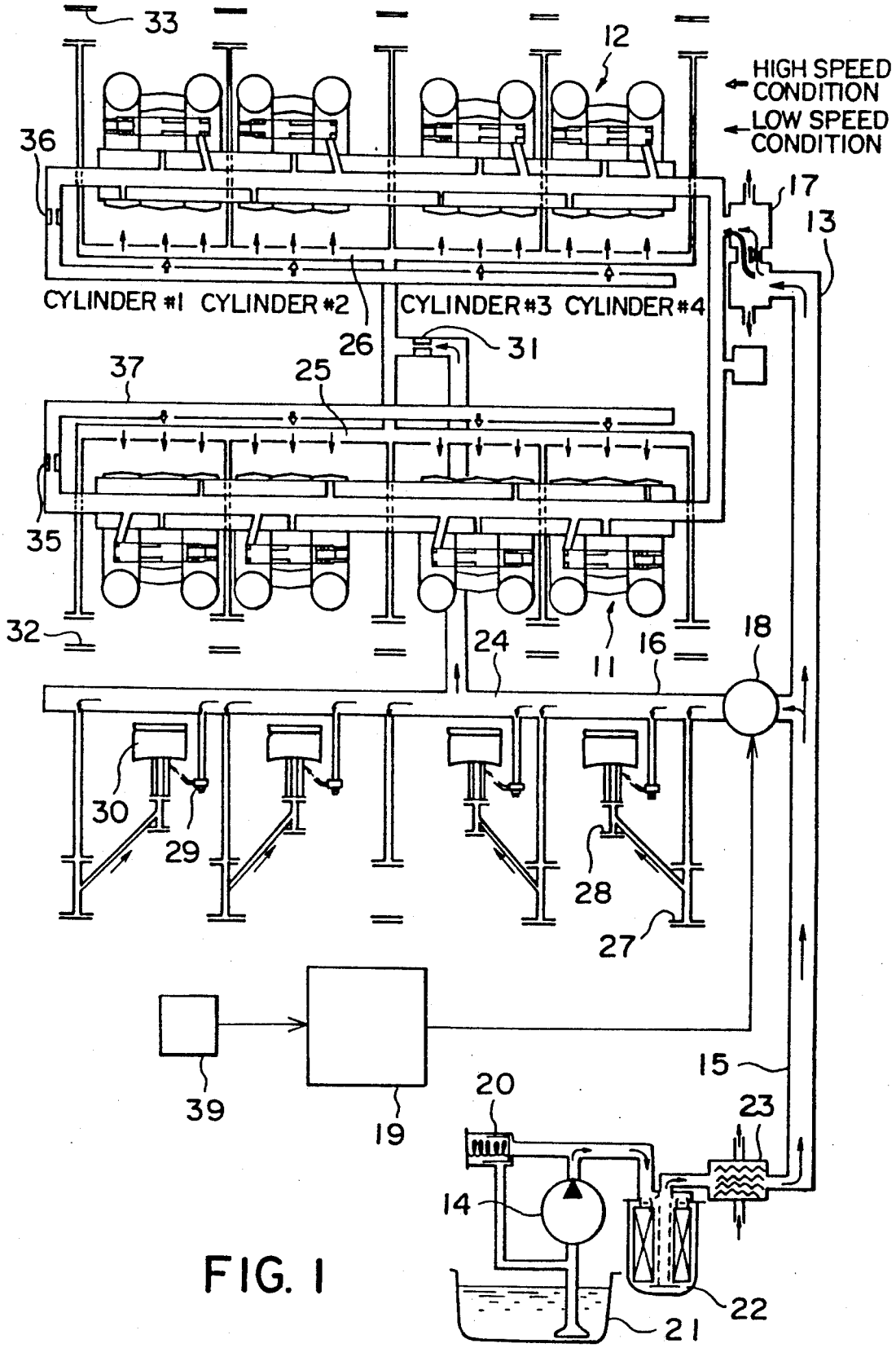
FIG. 1 is a schematic diagram of an oil pressure circuit in a variable cam engine according to this invention.

In FIG. 1, each cylinder 1–4 of a four cylinder engine is provided with a cam change-over mechanism 11 which opens and closes two intake valves, and a cam change-over mechanism 12 which opens and closes two exhaust valves.

An oil pump 14 is attached to the engine and is driven by the engine output torque. A delivery path 15 is connected to the pump outlet via a filter 22 and an oil cooler 23. The delivery path 15 is divided into a lubrication path 16 for delivering lubricating oil to engine rotating bearings and sliding parts, and an oil pressure path 13 for guiding change-over oil pressure to the aforesaid cam change-over mechanisms 11, 12. A throttle 18 is installed at the entrance of the lubrication path 16.

The oil pump 14 sucks lubricating oil stored in an oil pan 21, and supplies it to the delivery path 15. The discharge pressure of this oil pump 14 is adjusted to be below a fixed level by a relief valve 20.

The lubrication path 16 comprises a main gallery 24 formed along the engine crankshaft, and sub-galleries 25, 26 which run off the main gallery 24. Lubricating oil is thereby distributed from the main gallery 24 to the principal engine moving parts such as the crankshaft, pistons and connecting rods. Part of the oil which has entered the main gallery 24 lubricates crankshaft bearings 27, lubricates crank pins 28 from the inside of the crankshaft, and lubricates pistons 30 via spray nozzles 29.

The sub-galleries 25, 26 are formed along the intake camshaft and the exhaust camshaft. A restrictor 31 is provided between the sub-gallery 25 and the main gallery 24. Lubricating oil which has entered the sub-galleries 25, 26 lubricates intake camshaft bearings 32, exhaust camshaft bearings 33 and cam change-over mechanisms 11, 12.

The oil pressure path 13 supplies oil hydraulic pressure for activating the cam change-over mechanisms 11, 12, and it is provided with a pressure change-over valve 17 midway along its length.

Figure 2:
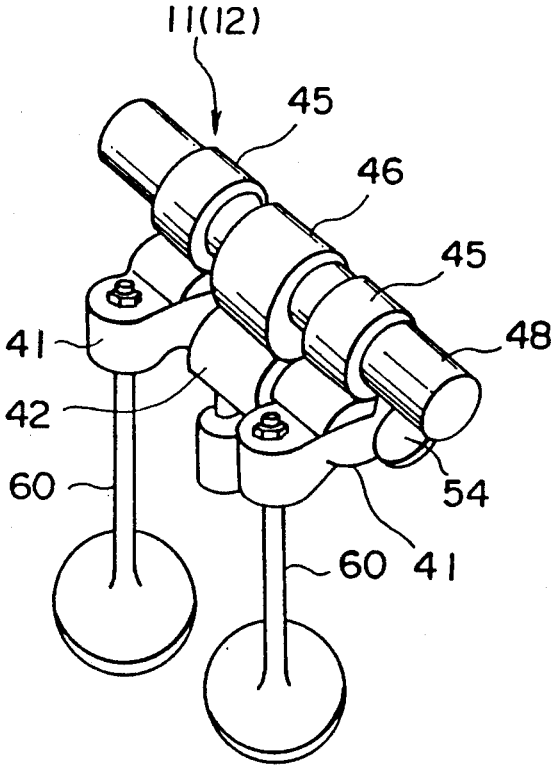
FIG. 2 is an enlarged perspective view of a cam change-over mechanism.

FIG. 2 shows the structure of the cam change-over mechanism 11. The cam change-over mechanism 11 is provided with two main rocker arms 41, and a sub-rocker arm 42 installed between these main rocker arms 41. The main rocker arms 41 and sub-rocker arm 42 pivot independently around the same shaft 54. An intake valve stem 60 is supported on the pivoting end of each of the main rocker arms 41, and moves up and down according to the motion of the main rocker arm 41 so as open and close the intake valve.

The main rocker arms 41 and sub-rocker arm 42 are pulled upwards by valve springs, not shown, and come into contact respectively with two first cams 45 and a second cam 46 situated between them. These first cams 45 and second cam 46 are fixed on the same camshaft and rotate together. The second cam 46 has a shape which gives a larger lift interval and lift amount than that of the first cams 45.

Figure 3:
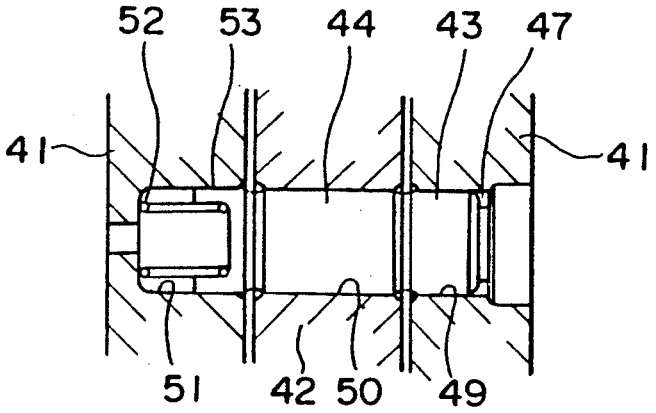
FIG. 3 shows an enlarged horizontal section through a rocker arm in the cam change-over mechanism.

A hole 49 is formed on one side of one of the main rocker arms 41 facing the sub-rocker arm 42 as shown in FIG. 3, and an engaging pin 43 is accommodated in the hole 49 such that it is free to slide. Another hole 51 is formed on one side of the other main rocker arm 41 facing the hole 49, and contains a plunger 53 pulled by a spring 52.

A throughhole 50 is also formed in the sub-rocker arm 42 corresponding to the holes 49, 51, an engaging pin 44 being provided in this hole such that it is free to slide. The holes 49, 51 and the throughhole 50 all have the same diameter.

These holes 49, 51 and the throughhole 50 are coaxial when the main rocker arms 41 and sub-rocker arm 42 are in the non-lift position.

When the oil pressure supplied from the oil pressure path 13 to an oil chamber 47 in the hole 49 rises above a predetermined level, the engaging pin 43 is pushed out towards the sub-rocker arm 42 so that part of it enters the throughhole 50. At the same time, the engaging pin 44 in the throughhole 50 is pushed out so that part of it enters the hole 51. This causes the sub-rocker arm 42 to engage with the main rocker arms 41 on both sides.

When the main rocker arms 41 are not engaged with the sub-rocker arm 42, the valve stems 60 are driven according to the characteristics of the first cams 45, but when the sub-rocker arm 42 is engaged, the valve stems 60 are driven according to the characteristics of the second cam 46 which is larger than the first cam.

When the pressure in the oil chamber 47 falls below the aforesaid predetermined level, the engaging pins 43, 44 are pushed back to the position shown in FIG. 3 by the plunger 53 under the tension of the spring 52, and the main rocker arms 41 are thereby disengaged from the sub-rocker arm 42. The engaging and disengaging of the main rocker arms 41 and sub-rocker arm 42 take place during the non-lift interval.

The cam change-over mechanism 12 has a similar construction to that of the aforesaid cam change-over mechanism 11.

Apart from the oil supplied to the oil chamber 47 of the cam change-over mechanisms 11, 12, part of the lubricating oil in the oil pressure path 13 flows into lubrication paths 37, 38 via restrictors 35, 36 so as to lubricate the cam change-over mechanisms 11, 12.

The pressure change-over valve 17 installed in the oil pressure path 13 is an electromagnetic valve whose opening area can be varied in two stages. By changing this surface area from small to large, the oil pressure supplied to the cam change-over mechanisms 11, 12 from the delivery path 15 is increased, and by reversing the selection, the oil pressure is decreased. The pressure change-over valve 17 is controlled by a controller, not shown, this change-over operation being performed at an engine speed of 2500 rpm.

The throttle 18 is an electromagnetic valve whose opening varies progressively according to a current supplied by a controller 19. The controller 19 controls the opening of the throttle 18 according to the detection value of a sensor 39 which detects engine speed and a map shown in FIG. 4. The throttle 18 has its maximum opening at very low engine speeds of 1000 rpm or less when the amount of oil discharged by the oil pump 14 is small. As cam change-over does not take place in this region, there is no need to supply pressure to the oil pressure path 13, so a suitable oil supply can be maintained to the principal engine moving parts from the lubrication path 16.

In the speed range from 1000–2000 rpm, the opening of the throttle 18 decreases in proportion to the increase of engine speed. As the engine speed increases, the amount of oil delivered by the oil pump 14 increases, however as the the opening of the throttle 18 is decreasing, the oil pressure Pa in the oil pressure path 13 rises as shown in FIG. 5.

Figure 4:
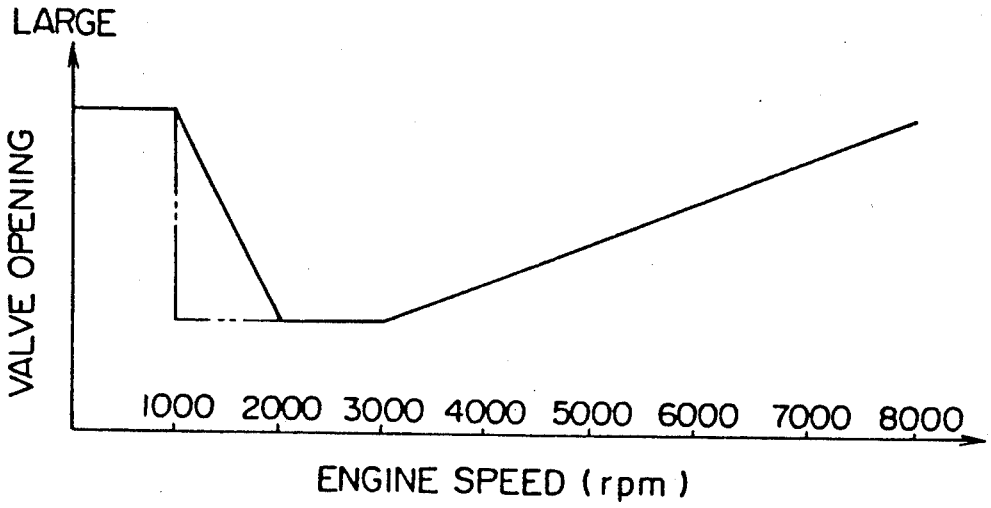
FIG. 4 is a control chart of a throttle according to this invention.

As the opening of the throttle 18 is decreased gradually and not abruptly as indicated by the broken line in FIG. 4, the decrease of flowrate in the lubrication path 16 is offset by the increase of flowrate in the delivery path 15 due to rise of pump speed. At the same time, the oil pressure Pb in the lubrication path 16 rises gradually with the engine speed. Even if the opening of the throttle 18 is decreased, therefore, the lubrication of engine parts is not impaired.

In the speed range 2000–3000 rpm, the throttle 18 has its minimum opening, and the oil pressure Pa in the oil pressure path 13 which increases with engine speed, reaches a level P required for cam change-over at 2500 rpm. In this speed range, the oil pressure Pa does not increase sharply but continuously from 1000–2000 rpm, and there is therefore no delay of pressure rise even if the engine is accelerated suddenly. When the opening of the pressure change-over valve 17 is increased at 2500 rpm, therefore, the pressure of the oil chamber 47 immediately increases to the cam change-over pressure, and the change-over from the first cams 45 to the second cam 46 takes place rapidly.

Figure 5:
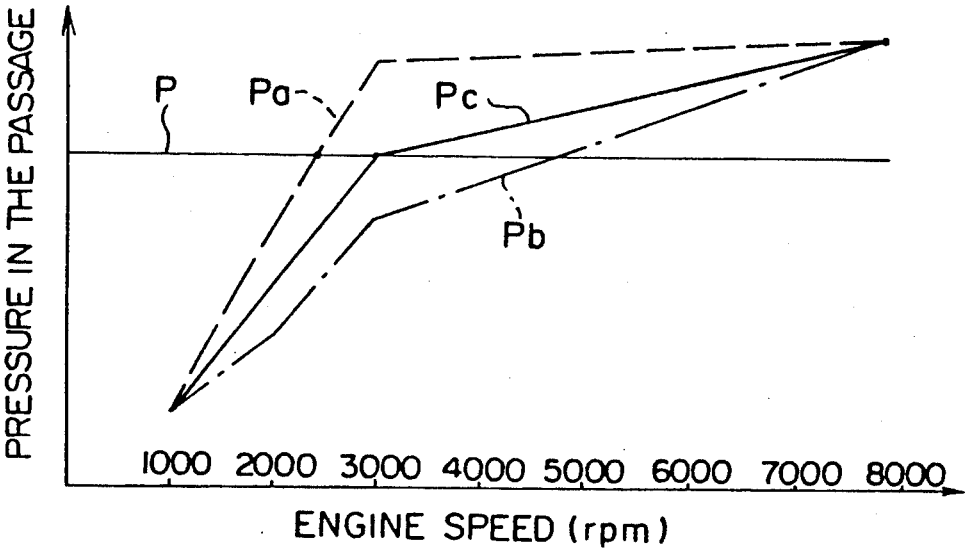
FIG. 5 is a chart of oil pressure in different flowpaths according to this invention.

The characteristics indicated by Pc in FIG. 5 show the pump discharge pressure when the throttle 18 is always kept open. It is seen that if the engine speed is less than 3000 rpm, the oil pressure Pc does not reach the required level P. In other words, below 3000 rpm, the pressure of the oil chamber 47 does not reach the cam change-over pressure even if the pressure change-over valve 17 is operated.

In the region above 3000 rpm, the opening of the throttle 18 increases in direct proportion to the rise of engine speed. In this region, the oil pump 14 rotates at high speed. The oil pressure Pb in the lubrication path 16 is increased while the pressure of the oil chamber 47 is maintained above the cam change-over pressure, so the principal engine moving parts such as the crankshaft are properly lubricated via the main gallery 24 after changing over to the second cam 46.

Due to the control of the opening of the throttle 18 by the controller 19 according to the engine speed, therefore, the oil pressure required for cam change-over is reached even in the low speed region without any loss of engine lubrication performance, and cam change-over is performed with good response.

The relief valve 20 in the delivery path 15 opens at a speed of approx. 3000 rpm. It controls excess rise of oil pressure, and lessens the drive load on the oil pump 14.

Figure 6:
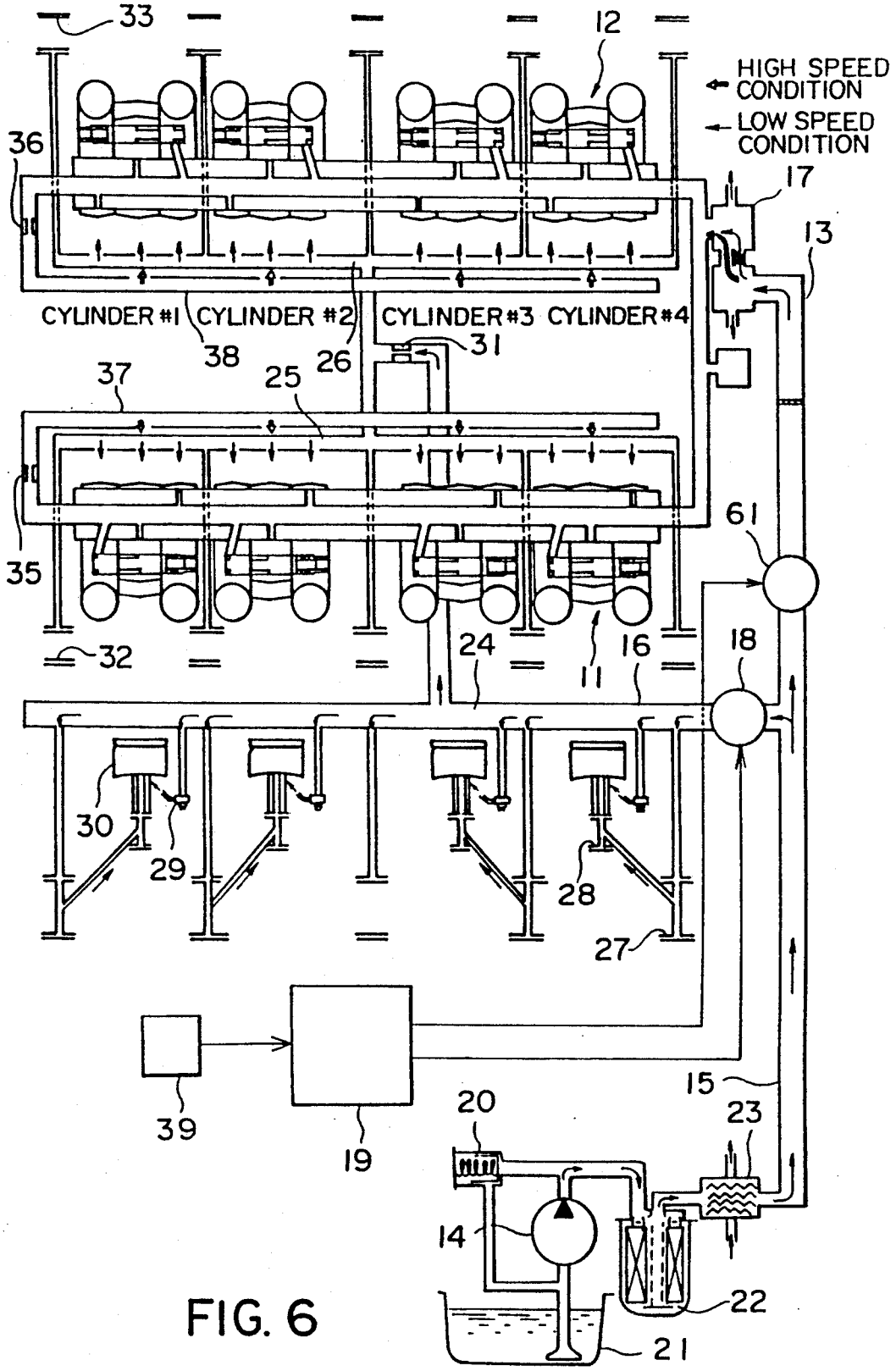
FIG. 6 is similar to FIG. 1, but illustrates another embodiment of this invention.

In a second embodiment of the invention shown in FIG. 6, a throttle 61 is also provided in the oil pressure path 13. In this construction, by throttling the throttle 61 in a predetermined high speed region, flow of oil into the oil pressure path 13 is controlled, leakage of oil from the cam change-over mechanisms 11, 12 or from the lubrication paths 37, 38 to the cylinder head is reduced, and recycling of oil to the lubricating oil pan 21 is thereby promoted.

This invention is not limited to the above embodiments, various modifications being possible by those skilled in the art without departing from the scope of the claims appended thereto.

The embodiments of this invention in which an exclusive property or privilege is claimed are as follows:

1. A variable cam engine comprising:
an intake valve;
an exhaust valve;
a plurality of cams of different shape which open and close one of said valves;
a cam change-over mechanism driven by pressurized oil which changes over said cams when a pressure of the pressurized oil rises above a predetermined level;
an oil pump which rotates according to the engine speed;
a lubrication path which supplies lubricating oil discharged by said oil pump to engine parts;
an oil pressure path which supplies part of the lubricating oil to said cam change-over mechanism, said oil pressure path being connected to said oil pump in parallel with said lubrication path;
a throttle provided in said lubrication path;
means for detecting engine speed; and
control means for throttling said throttle when the engine speed is in a predetermined low speed region.

2. A variable cam engine comprising:
an intake valve;
an exhaust valve;
a plurality of cams of different shape which open and close one of said valves;
a cam change-over mechanism driven by pressurized oil which changes over said cams when a pressure of the pressurized oil rises above a predetermined level;
an oil pump which rotates according to the engine speed;
a lubrication path which supplies lubricating oil discharged by said oil pump to engine parts;
an oil pressure path which supplies part of the lubricating oil to said cam change-over mechanism;
a throttle provided in said lubrication path;
means for detecting engine speed; and
control means for throttling said throttle when the engine speed is in a region from approximately 1000 to 3000 rpm,
wherein said cam change-over mechanism performs cam change-over when the engine speed is in a region from approximately 2000 to 3000 rpm.

3. A variable cam engine as defined in claim 2, wherein said control means maintains said throttle fully open when the engine speed is below approx. 1000 rpm, reduces the throttle opening according to the engine speed from approx. 1000 to 2000 rpm, and maintains the minimum throttle opening from approx. 2000 to 3000 rpm.

4. A variable cam engine comprising:
an intake valve;
an exhaust valve;
a plurality of cams of different shape which open and close one of said valves;
a cam change-over mechanism driven by pressurized oil which changes over said cams when a pressure of the pressurized oil rises above a predetermined level;
an oil pump which rotates according to the engine speed;
a lubrication path which supplies lubricating oil discharged by said oil pump to engine parts;
an oil pressure path which supplies part of the lubricating oil to said cam change-over mechanism, said oil pressure path being connected to said oil pump in parallel with said lubrication path;
a throttle provided in said lubrication path;
means for detecting engine speed; and
control means for throttling said throttle when the engine speed is in a predetermined low speed region such that the pressure of the pressurized oil supplied to said cam change-over mechanism rises above said predetermined level whereby said cam change-over mechanism changes over.

5. A variable cam engine comprising:
an intake valve;
an exhaust valve;
a plurality of cams of different shapes which open and close one of said valves;
a cam change-over mechanism driven by pressurized oil which changes over said cams when a pressure of the pressurized oil rises above a predetermined level;
an oil pump which rotates according to the engine speed;
a lubrication path which supplies lubricating oil discharged by said oil pump to engine parts;
an oil pressure path which supplies part of the lubricating oil to said cam change-over mechanism;
a throttle;
means for detecting engine speed; and
means for controlling an opening of said throttle so that lubricating oil supplied by said oil pump is proportioned between said oil pressure path and said lubrication path in accordance with changes in engine speed.

* * * * *